US010730291B2

(12) United States Patent
Kobayashi et al.

(10) Patent No.: US 10,730,291 B2
(45) Date of Patent: Aug. 4, 2020

(54) LIQUID EJECTION HEAD AND RECORDING APPARATUS

(71) Applicant: CANON KABUSHIKI KAISHA, Tokyo (JP)

(72) Inventors: Masakazu Kobayashi, Tokyo (JP); Koichi Ishida, Tokyo (JP); Shuzo Iwanaga, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/371,962

(22) Filed: Apr. 1, 2019

(65) Prior Publication Data

US 2019/0308412 A1 Oct. 10, 2019

(30) Foreign Application Priority Data

Apr. 6, 2018 (JP) ..... 2018-073919

(51) Int. Cl.

| | |
|---|---|
| ***B41J 2/05*** | (2006.01) |
| ***B41J 2/155*** | (2006.01) |
| ***B41J 2/14*** | (2006.01) |
| ***B41J 2/045*** | (2006.01) |

(52) U.S. Cl.

CPC ..... *B41J 2/05* (2013.01); *B41J 2/04501* (2013.01); *B41J 2/14* (2013.01); *B41J 2/1404* (2013.01); *B41J 2/155* (2013.01); *B41J 2002/14475* (2013.01); *B41J 2202/20* (2013.01); *B41J 2202/21* (2013.01)

(58) Field of Classification Search

CPC ... B41J 2/01; B41J 2/04501; B41J 2/05; B41J 2/14; B41J 2/1404; B41J 2/155; B41J 2002/14475; B41J 2202/20; B41J 2202/21

See application file for complete search history.

(56) References Cited

U.S. PATENT DOCUMENTS

2004/0185693 A1* 9/2004 Yamaguchi ..... B41J 2/04543 439/79
2005/0134617 A1* 6/2005 Yamaguchi ..... B41J 2/155 347/5
2005/0140722 A1 6/2005 Shibata (Continued)

FOREIGN PATENT DOCUMENTS

JP 3907685 B2 4/2007

*Primary Examiner* — Anh T Vo

(74) *Attorney, Agent, or Firm* — Canon U.S.A., Inc. IP Division

(57) ABSTRACT

A liquid ejection head including recording element substrates each including ejection opening rows in which ejection openings ejecting liquid are arranged, the plurality of ejection opening rows being juxtaposed in a relative movement direction with respect to the printed medium. In the relative movement direction of the printed medium when the printed medium is viewed from the liquid ejection head, and in the plurality of ejection opening rows provided in the recording element substrate, among the plurality of recording element substrates, positioned on an upstream side in the relative movement direction, arrangement intervals of ejection openings in an end area of an ejection opening row positioned on a most upstream side in the relative movement direction are smaller than arrangement intervals of ejection openings in an end area of an ejection opening row positioned on a most downstream side in the relative movement direction.

16 Claims, 10 Drawing Sheets

(56) References Cited

U.S. PATENT DOCUMENTS

2008/0252673 A1* 10/2008 Wada ..... B41J 2/04505
347/12
2012/0050377 A1* 3/2012 Ueshima ..... B41J 2/04501
347/19

* cited by examiner

LIQUID EJECTION HEAD AND RECORDING APPARATUS

BACKGROUND OF THE DISCLOSURE

Field of the Disclosure

The present disclosure relates to a liquid ejection head and a recording apparatus that eject liquid such as ink on a printed medium to perform recording.

Description of the Related Art

Ink jet recording apparatuses which eject droplets with a liquid ejection head to perform recording are widely used. Until droplets ejected from ejection openings of a liquid ejection head land on a printed medium, the air having viscosity situated around the flying droplets is dragged by the movement of the droplets and is moved as well. With the above, an area between an ejection opening surface provided with the ejection openings and the printed medium tends to become lower in pressure than the surroundings thereof, and the surrounding air flows into the above pressure decreased area. It is known that as a result of the above, the droplets ejected particularly from ejection openings, among the ejection openings included in the ejection opening row, positioned at both ends of the ejection openings in an array direction of the ejection openings are drawn to a center side in an ejection openings array direction; accordingly, the droplets do not land on the predetermined position in the printed medium.

With respect to the deviation of the landing position caused by such an airflow generated by ejection of the droplets (hereinafter referred to as an autogenous airflow), Japanese Patent Publication No. 3907685 describes a method in which arrangement intervals of the ejection openings positioned at both ends in the array direction of the ejection openings are set larger than those on the center side in the array direction. It is stated that with the above, the positions of the droplets that land on the printed medium can be corrected to the desired positions and a high quality printed image can be obtained.

In recent years, ink jet recording apparatuses have been used not only for household printing, but also for business printing such as commercial printing and retail photo printing, and the usage of ink jet recording apparatus is increasing. Liquid ejection heads used in such business printing are required to have higher recording performance in speed and in quality. As an example of satisfying such a requirement, recording of printed mediums has been performed while increasing the speed of the relative movement between the recorded medium and the liquid ejection head (hereinafter, merely referred to as relative movement).

As the speed of the relative movement is increased, the influence of an airflow flowing between an ejection opening surface of the liquid ejection head and the printed medium (hereinafter, merely referred to as an inflowing airflow) becomes larger. It is difficult of suppress such an influence exerted by the inflowing airflow with the method described in Japanese Patent No. 3907685.

SUMMARY OF THE DISCLOSURE

The present disclosure provides a liquid ejection head capable of suppressing deviation of a landing position of a droplet caused by an inflowing airflow, while achieving high speed recording.

The present disclosure in one aspect is a liquid ejection head including recording element substrates that each include a plurality of ejection opening rows in which ejection openings that eject liquid on a printed medium are arranged, the plurality of ejection opening rows being arranged side by side in a relative movement direction with respect to the printed medium. In the liquid ejection head, in the relative movement direction of the printed medium when the printed medium is viewed from the liquid ejection head, and in the plurality of ejection opening rows provided in the recording element substrate, among the plurality of recording element substrates, positioned on an upstream side in the relative movement direction, arrangement intervals of ejection openings in an end portion area of an ejection opening row positioned on a most upstream side in the relative movement direction are smaller than arrangement intervals of ejection openings in an end portion area of an ejection opening row positioned on a most downstream side in the relative movement direction.

Furthermore, the present disclosure in another aspect is a recording apparatus including a liquid ejection head that ejects liquid on a printed medium, and a conveying member that conveys the printed medium to the liquid ejection head. In the recording apparatus, the liquid ejection head includes recording element substrates that each include a plurality of ejection opening rows in which ejection openings that eject the liquid on the printed medium are arranged, the plurality of ejection opening rows being arranged side by side in a relative movement direction with respect to the printed medium, and in the relative movement direction of the printed medium when the printed medium is viewed from the liquid ejection head, and in the plurality of ejection opening rows provided in the recording element substrate, among the plurality of recording element substrates, positioned on an upstream side in the relative movement direction, arrangement intervals of ejection openings in an end portion area of an ejection opening row positioned on a most upstream side in the relative movement direction are smaller than arrangement intervals of ejection openings in an end portion area of an ejection opening row positioned on a most downstream side in the relative movement direction.

Further features and aspects of the disclosure will become apparent from the following description of exemplary embodiments with reference to the attached drawings.

DESCRIPTION OF THE EMBODIMENTS

Hereinafter, example embodiments and various aspects of the present disclosure will be described with reference to the drawings.

Note that a liquid ejection head of the present disclosure that ejects a liquid such as ink and a recording apparatus equipped with the liquid ejection head can be applied to devices such as a printer, a copier, a facsimile including a communication system, and a word processor including a printer unit. Furthermore, the liquid ejection head and the recording apparatus can be used in industrial recording apparatuses that combine various kinds of processing apparatus in a multiple manner. The liquid ejection head and the recording apparatus can also be used, for example, for fabricating biochips, for printing electronic circuits, for fabricating semiconductor substrates, and in 3D printing.

First Example Embodiment

Description of Recording Apparatus

Figure 1:
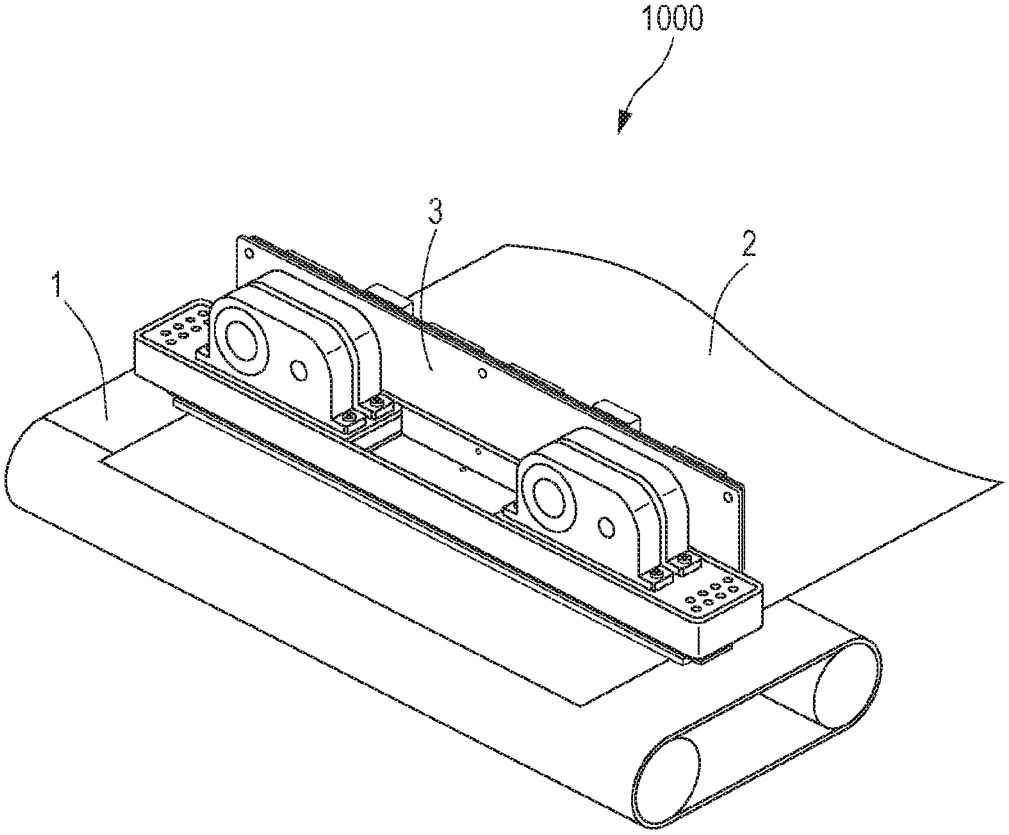
FIG. 1 is a perspective of an example recording apparatus including a liquid ejection head.

Referring to FIG. 1, a configuration of a recording apparatus according to a first example embodiment will be described. FIG. 1 illustrates a recording apparatus 1000 equipped with a liquid ejection head 3, which ejects liquid, according to the present example embodiment. The recording apparatus 1000 includes a conveying unit 1 that conveys a printed medium 2 such as paper, and a page wide type liquid ejection head 3 disposed substantially orthogonal to a conveyance direction of the printed medium 2. The recording apparatus 1000 is a page wide type recording apparatus that performs continuous recording in one pass while conveying the printed medium 2 continuously or intermittently.

Furthermore, other than the above, the recording apparatus 1000 includes an ink tank (not shown) that contains ink, a liquid supply passage (not shown) that supplies the ink from the ink tank to the liquid ejection head 3, an electric control unit (not shown) that transmits power and an ejection control signal to the liquid ejection head 3, and the like. In the present example embodiment, the conveyance speed of printed medium 2 is 6 ips.

Description of Liquid Ejection Head

Figure 2A:
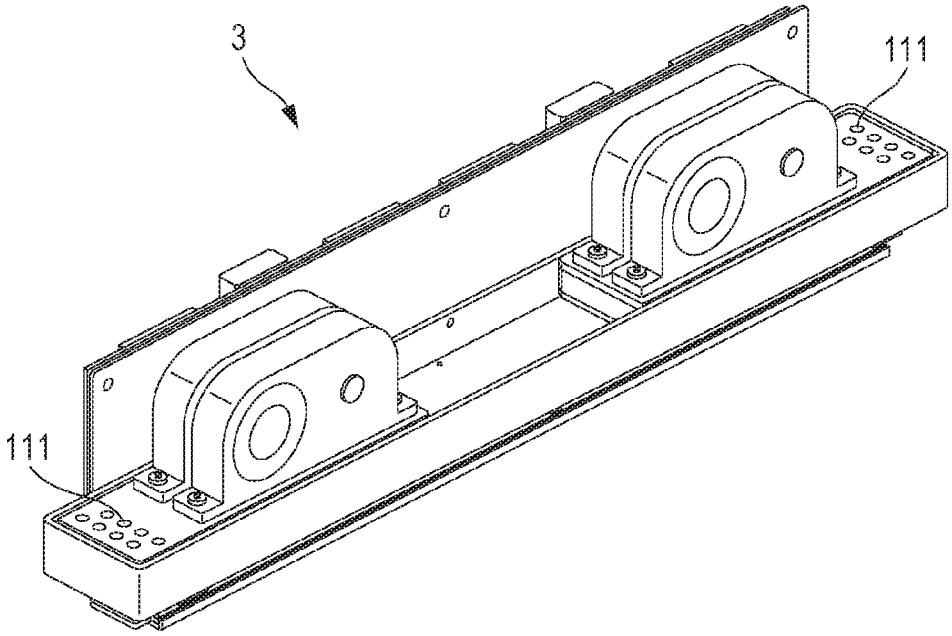
FIG. 2A is a perspective view of a liquid ejection head according to a first example embodiment.
Figure 2B:
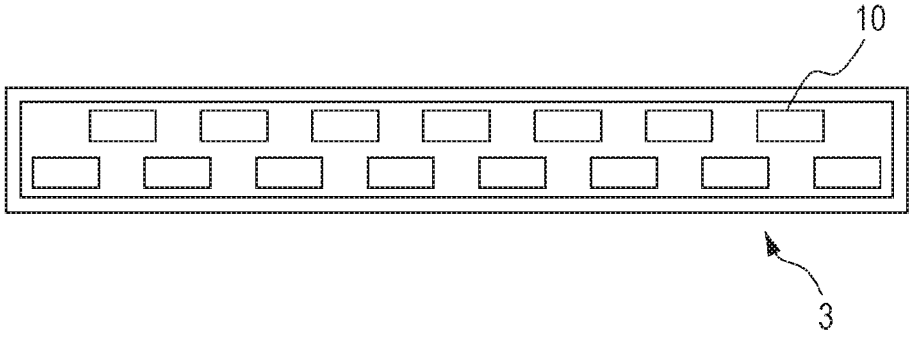
FIG. 2B is a schematic view of the liquid ejection head viewed from a recording element substrate side.

Referring to FIGS. 2A and 2B, a configuration of the liquid ejection head 3 according to a first example embodiment will be described. FIG. 2A is a perspective view of the liquid ejection head 3 according to the present example embodiment, and FIG. 2B is a schematic view of the liquid ejection head viewed from the recording element substrate side.

The liquid ejection head 3 includes recording element substrates 10, a flexible wiring substrate (not shown), and an electric wiring board (not shown). Signal input terminals (not shown) and power supply terminals (not shown) are provided in the electric wiring board. The signal input terminals and the power supply terminals are electrically connected to the electric control unit (not shown) provided in the recording apparatus 1000, and supply electric power necessary for the ejection drive signal and the ejection to the recording element substrates 10. The number of signal output terminals and the number of power supply terminals can be small compared to the number of recording element substrates 10 owing to an electric circuit in which wiring provided in the electric wiring board is integrated. With the above, the number of electric connection portions need to be removed when installing the liquid ejection head 3 in the recording apparatus 1000 or when replacing the liquid ejection head can be small.

As illustrated in FIG. 2A, liquid connection portions 111 provided in both end portions of the liquid ejection head 3 are connected to a liquid supply system (not shown) provided in the recording apparatus 1000. With the above, a configuration allowing circulation is formed, in which ink of four colors, namely, C, M, Y, and K are supplied from the liquid supply system (not shown) of the recording apparatus 1000 to the liquid ejection head 3 and is collected into a supply system of the recording apparatus 1000 after passing through pressure chambers 23 (FIG. 3B) inside the recording element substrates 10.

The liquid ejection head 3 is a page wide type liquid ejection head in which 15 recording element substrates 10 capable of ejecting the ink of four colors C, M, Y, and K are arranged in a zigzag manner as illustrated in FIG. 2B. The liquid ejection head 3 is detachable from the recording apparatus 1000.

Description of Recording Element Substrate

Figure 3A:
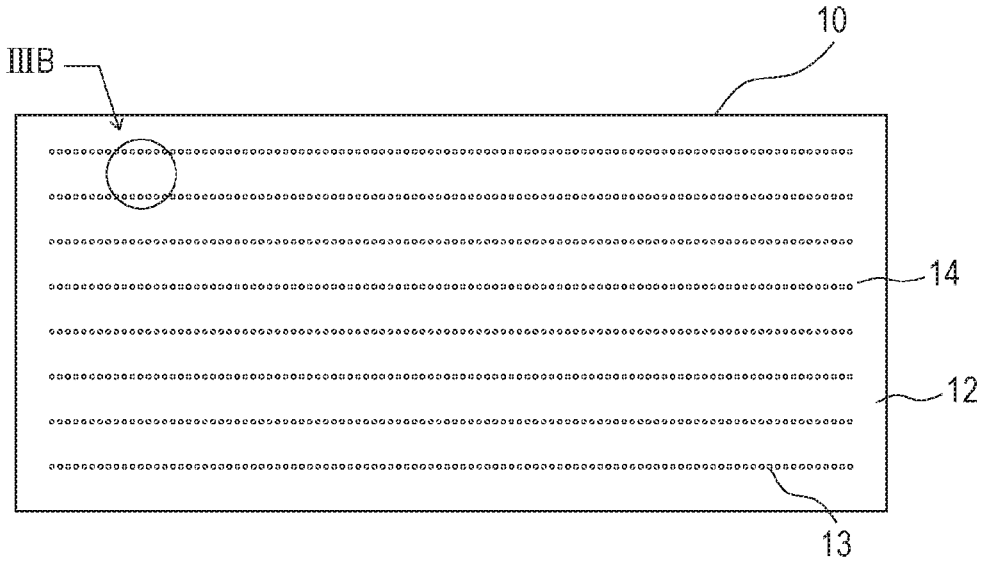
FIG. 3A is a schematic view illustrating a recording element substrate of the liquid ejection head according to the first example embodiment.

A configuration of the recording element substrate 10 according to the present example embodiment will be described with reference to FIGS. 3A and 3B. FIG. 3A is a plan view of a surface of the recording element substrate 10 on the side in which ejection openings 13 are formed, and FIG. 3B is an enlarged view of an area indicated by IIIB in FIG. 3A.

As illustrated in FIG. 3A, an outer shape of the recording element substrate 10 in the present example embodiment is substantially rectangular, and a plurality of ejection opening rows are formed therein. As illustrated in FIG. 2B, the liquid ejection head of a page wide type is formed by arranging a plurality of recording element substrates 10 in a zigzag manner in the longitudinal direction of the liquid ejection head 3. The recording element substrates 10 are each formed of a substrate (not shown) in which energy generating elements 15, supply ports 17*a*, collection ports 17*b*, and the like described below are formed and ejection openings forming member 12 in which ejection openings 13 are formed layered on each other. For example, the substrate is formed of Si and the ejection openings forming member 12 is formed of a resin member.

Figure 3B:
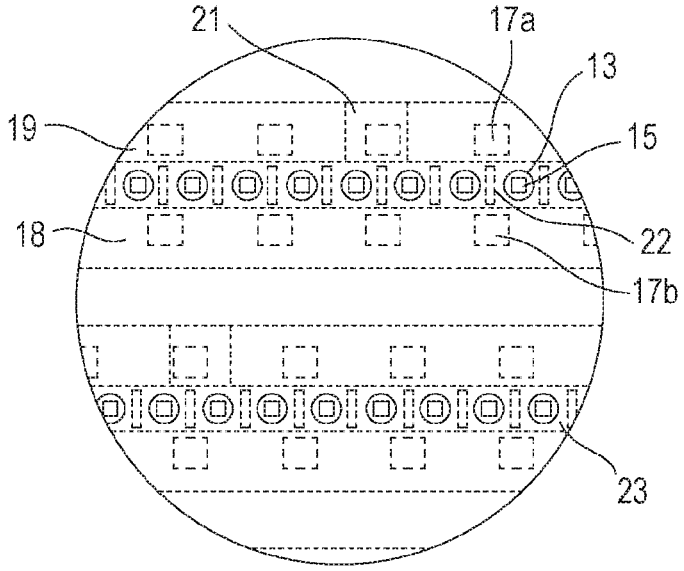
FIG. 3B is an enlarged view of the area IIIB in FIG. 3A.

The ejection openings 13 illustrated in FIG. 3B are openings configured to eject droplets on the printed medium 2. In the present example embodiment, in order to obtain a printed image of high quality, a dimension of the opening of each ejection opening and the like are set so that a droplet having a minute volume of 2.0 picoliters is ejected by a single drive of the liquid ejection head. The energy generating elements 15 play a role of heating the liquid by thermal energy and film boiling the liquid, and eject droplets from the ejection openings 13 by foaming pressure of the film boiling. The energy generating elements 15 are disposed at positions corresponding to the ejection openings 13. The pressure chambers 23 are spaces that include the energy generating elements 15 and that store the liquid upon which the foaming pressure created by the energy generating elements 15 acts. The partition walls 22 partition the pressure chambers 23 from each other.

The energy generating elements 15 are electrically connected to the terminals (not shown) of the recording element substrates 10 by electric wiring (not shown) provided in the recording element substrates 10. Each energy generating element 15 generates heat based on a pulse signal input from a control circuit of the recording apparatus 1000 sequentially through the electric wiring board, the flexible wiring substrate, and the terminals. Note that the energy generating elements 15 are not limited to heating elements, and various types such as piezo elements and the like can be used.

The liquid supplied from the recording apparatus 1000 is supplied into the liquid ejection head 3 through the liquid connection portions 111 (FIG. 2A), and is supplied to openings 21 of each recording element substrate 10 through a common supply passage (not shown). The liquid supplied through the openings 21 to the recording element substrates 10 is ejected from the ejection openings 13 after being supplied into the pressure chambers 23 through the liquid supply passages 18 and the supply ports 17*a*. The liquid that has not been ejected flows out from the pressure chambers 23 to the outside of the recording element substrates 10 through the collection ports 17*b* and the liquid collection passages 19, and after passing through a common collection passage (not shown), the liquid is collected to a portion external to the liquid ejection head 3 through the liquid connection portions 111. The liquid ejection head 3 in the present example embodiment is, in the above manner, configured so that the liquid in the pressure chambers can be circulated to a portion external to the pressure chambers 23. Note that in the present example embodiment, the gap between the printed medium 2 and an ejection opening surface of each recording element substrate 10 where the ejection openings are formed is 1.5 mm.

Description of Ejection Opening Rows

Figure 4A:
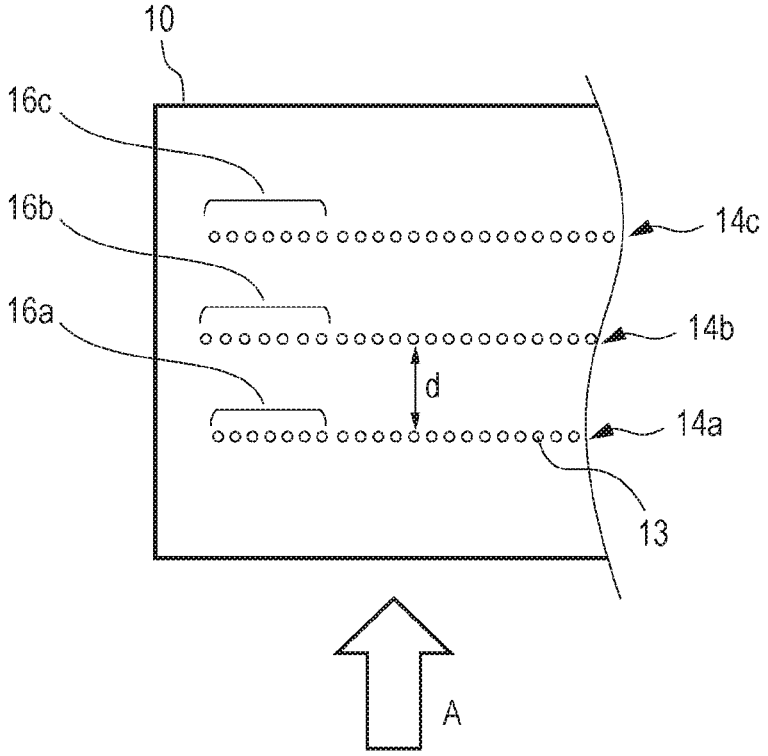
FIG. 4A is a schematic view illustrating a configuration of the recording element substrate of the liquid ejection head according to the first example embodiment.
Figure 4B:
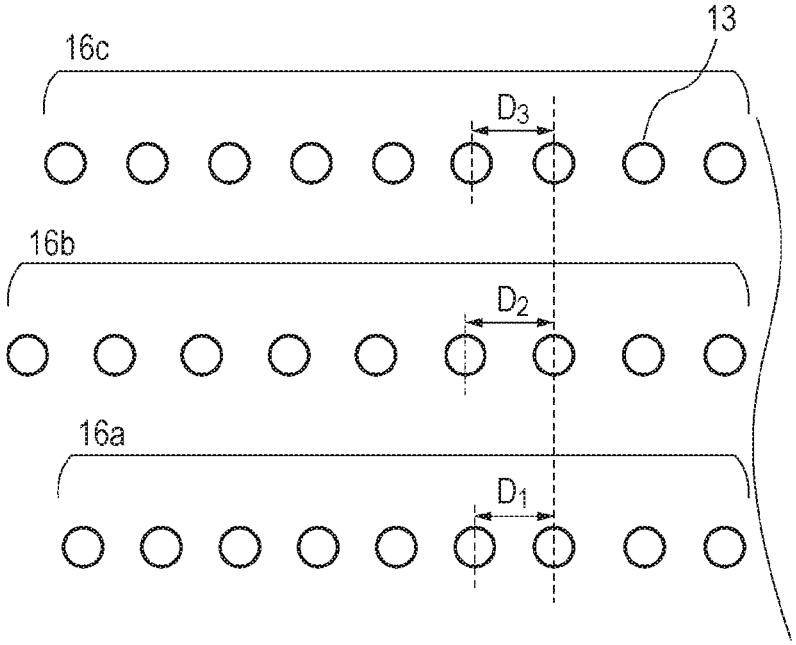
FIG. 4B is a schematic view illustrating an end portion of the recording element substrate in an enlarged manner.

FIGS. 4A and 4B are schematic views illustrating an area in an end portion of the recording element substrate 10 of the present example embodiment in an enlarged manner. Note that for simplicity of description, FIG. 4 illustrates a substantially rectangular recording element substrate in which three ejection opening rows 14 are arranged; however, the present example embodiment is not limited to the above configuration. The ejection opening rows may include 10 rows or 32 rows, for example. For the sake of description, only an end portion of the recording element substrate on one end side is illustrated in the recording element substrates in FIG. 4A and after, however, the other end side of the recording element substrate has a configuration that is similar to that on the one end side. Hereinafter, a direction of the relative movement of the printed medium 2 when viewing the printed medium 2 from the liquid ejection head 3 during an operation of ejecting the liquid from the liquid ejection head is referred to as a relative movement direction. An arrow A in the drawing indicates the relative movement direction.

As illustrated in FIG. 4A, in the recording element substrate 10, a plurality of ejection opening rows 14 are formed side by side in the relative movement direction. Furthermore, the ejection opening rows (14*a* to 14*c*) are each formed by arranging a plurality of ejection openings 13 in a direction intersecting the relative movement direction. In the present example embodiment, a distance d between adjacent ejection opening rows is set to 0.4 mm.

FIG. 4B illustrates ejection openings (16*a* to 16*c*) in an end portion area of the ejection opening rows (14*a* to 14*c*). In the present example embodiment, arrangement intervals of the ejection openings in the end portion area are different in each row. $D_1$ to $D_3$ in the drawing indicate the arrangement intervals of the ejection openings of the ejection opening rows in the end portion area. In the present example embodiment, $D_1$=42.4 μm, $D_2$=43.0 μm, and $D_3$=42.7 μm are satisfied. While the above will be described in detail in the description of FIG. 6A, a component 102 of an autogenous airflow (FIG. 6A) acting on a center ejection opening row 14*b* is larger than a composite component 33*b* (FIG. 6A) of the autogenous airflow that acts on a most downstream side ejection opening row 14*c* and an inflowing airflow. Among the plurality of ejection opening rows formed in the recording element substrate, the arrangement interval $D_1$ of the ejection openings 16*a* at the end portion of the ejection opening rows 14*a* on the most upstream side in the relative movement direction A is smaller than the arrangement interval $D_3$ of the ejection openings 16*c* at the end portion of the ejection opening row 14*c* on the most downstream side.

Note that in the present example embodiment, the arrangement intervals within each of the plurality of ejection openings (16*a* to 16*c*) included in the end portion area of the corresponding one of the ejection opening rows (14*a* to 14*c*) are the same. For example, each of the arrangement intervals between the ejection openings 16*a* at the end portion of the ejection opening row 14*a* is 42.4 μm and each of the arrangement intervals of the ejection openings 16*c* at the end portion of the ejection opening row 14*c* is 42.7 μm. Furthermore, in each ejection opening rows 14*a* to 14*c*, the arrangement intervals of the ejection openings in the center area (not shown) in the arrangement direction are 42.3 μm (600 dpi). When the influence of not only the autogenous airflow but also the influence of the inflowing airflow is taken into consideration, compared with when the influence of the autogenous airflow alone is taken into consideration and the arrangement intervals of the ejection openings at the end portion area are set uniformly, deviation in the droplet landing position can be suitably suppressed. Note that the number of ejection openings constituting the ejection openings at the end portion area differ according to the driving condition. In the present example embodiment, the number of ejection openings in each of the end portion areas 16*a* to 16*c* is set to seven. Details and effects of such a configuration will be described below.

Inflowing Airflow

Figure 5:
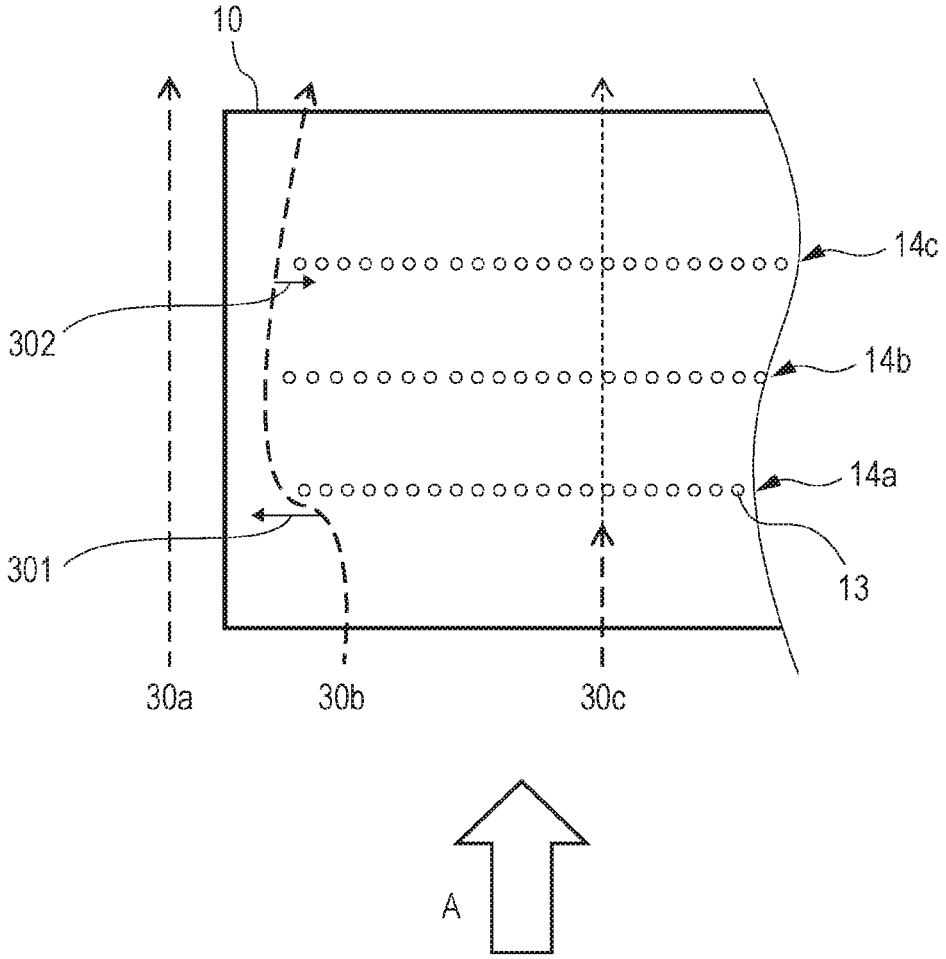
FIG. 5 is a diagram schematically illustrating an inflowing airflow in the first example embodiment

An influence of the inflowing airflow will be described below with reference to FIGS. 5, 6A, and 6B. FIG. 5 illustrates directions in which the inflowing airflows (30*a* to 30*c*) flow in a state in which the ink is ejected from a plurality of ejection openings and recording is performed while the liquid ejection head 3 and the printed medium 2 are moved relative to each other.

Owing to the relative movement, the inflowing airflows (30*a* to 30*c*) occur between the ejection opening surface in which the ejection openings 13 of the liquid ejection head 3 are formed and the printed medium 2. Note that the inflowing airflow 30*a* flowing outside the ejection opening rows flows in a straight line. However, in a state in which the ink is ejected from the plurality of ejection openings 13, a so-called air curtain is formed in the direction from the ejection openings to the printed medium due to the flying droplets; accordingly, it is difficult for the inflowing airflow to pass through the area where the ejection opening rows 14 are formed. Accordingly, a portion (30*b*) of the inflowing airflow flows to the end portion side of the ejection opening row 14*a*, and a flow that bypasses the ejection opening row 14*a* occurs. Subsequently, the inflowing airflow 30*b* becomes a flow that flows toward the center side (the right side in FIG. 5) of the ejection opening rows 14*c* at an area near the ejection opening row 14*c*. Accordingly, the inflowing airflow 30*b* acts to drag the droplet towards the end portion side (the left side) at the vicinity of the ejection opening row 14*a* on the most upstream side, and acts to drag the droplet towards the center side (the right side) at the vicinity of the ejection opening row 14*c* on the most downstream side. In the area in the vicinity of the ejection opening row 14*b*, the inflowing airflow flows, substantially, in the relative movement direction; accordingly, the inflowing airflow has almost no effect of dragging the droplet towards the end portion side or the center side. The inflowing airflow 30*c* flowing in an area other than the end portions of the ejection opening rows (14*a* to 14*c*) in a straight line in the relative movement direction is weakened by the air curtain.

Figure 6A:
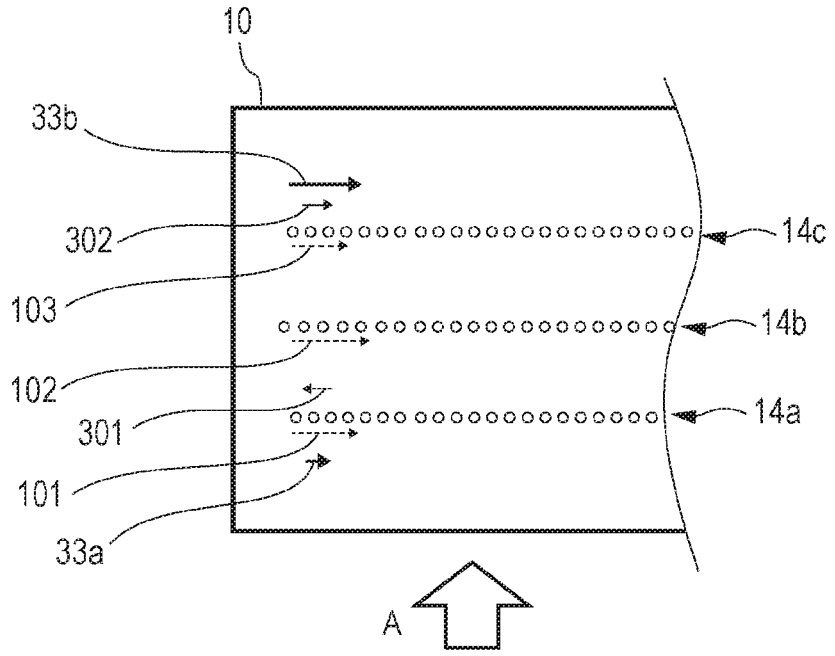
FIG. 6A is a schematic view schematically illustrating an autogenous airflow in a case in which the inflowing airflow is smaller than the autogenous airflow and a composite component thereof.
Figure 6B:
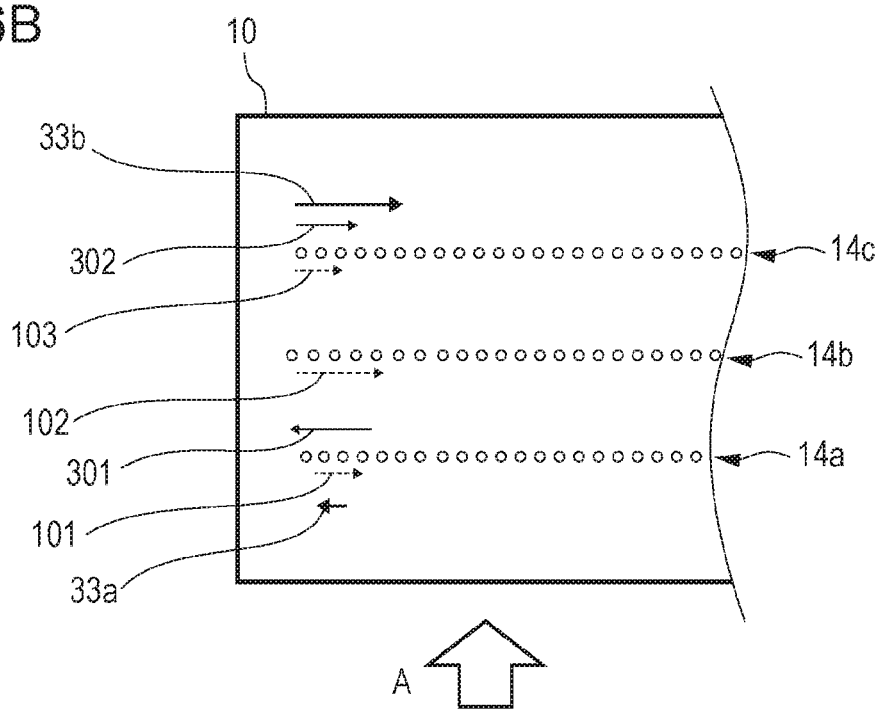
FIG. 6B is a schematic view schematically illustrating the autogenous airflow in a case in which the inflowing airflow is larger than the autogenous airflow and a composite component thereof.

Directions and sizes of the inflowing airflow 30*b* flowing through the end portions of the ejection opening rows (14*a* to 14*c*) decomposed in the arrangement direction of ejection openings are schematically illustrated in FIGS. 6A and 6B by arrows (301 and 302). As described above, the droplet ejected from the ejection opening 13 positioned in the end portion area of the ejection opening row 14*a* on the most upstream side in the relative movement direction is dragged in the end portion direction illustrated by arrow 301. Meanwhile, the droplet ejected from the ejection opening 13 positioned in the end portion area of the ejection opening row 14*c* on the most downstream side in the relative movement direction is dragged towards the center side illustrated by arrow 302. With the above, the droplet lands on the printed medium 2 at a position deviated from the desired position. In other words, due to the influence of the inflowing airflow, the droplet ejected from the ejection opening at the end portion area of the ejection opening row 14*a* is deviated to the left side with respect to the desired landing position and the droplet ejected from the ejection opening at the end portion area of the ejection opening row 14*c* is deviated to the right side with respect to the desired landing position.

The influence of such an inflowing airflow acts largely on the ejection opening rows on the most upstream side and on the most downstream side in the plurality of ejection opening rows formed in the recording element substrate 10. Accordingly, in order to correct the deviation in the landing positions of the droplets, in the present example embodiment, the arrangement intervals of the ejection openings in the end portion area of the ejection opening row 14*a* on the most upstream side of the recording element substrate 10 are set small, and arrangement intervals of the ejection openings in the end portion area of the ejection opening row 14*c* on the most downstream side are set large. In other words, the arrangement intervals of the ejection openings in the end portion of the ejection opening row 14*a* on the most upstream side is set smaller than the arrangement intervals of the ejection openings in the end portion of the ejection opening row 14*c* on the most downstream side. The application of the present disclosure is not limited to only the ejection opening rows on the most upstream side and the most downstream side, and the arrangement intervals of the ejection openings in the end portion area of the ejection opening row adjacent to the ejection opening row positioned on the most upstream side may be set smaller than the arrangement intervals of ejection openings in the end portion area of the ejection opening row adjacent to the ejection opening row positioned on the most downstream side. The above is because, depending on the size of the inflowing airflow, the influence of the inflowing airflow is exerted on the ejection opening rows other than those on the most upstream side and the most downstream side. With such a configuration, deviations in the landing positions of the droplets can be suppressed further.

The deviation in the landing positions of the droplets owing to such inflowing airflow becomes significant when a droplet having a minute volume of 10 picoliters or less is ejected since the inertial mass of the droplet becomes small. The influence of the inflowing airflow on the deviation of the landing positions of the droplets becomes more significant when the relative movement speed between the printed medium and the liquid ejection head is 0.4 m/s or more, when the distance between the printed medium and the liquid ejection head is 2 mm or less, and when the array density of the ejection openings of the liquid ejection head is 600 dpi or more. The present disclosure can be applied more suitably to such cases.

Autogenous Airflow

In addition to the inflowing airflow described above, an autogenous airflow created by the ejection of the droplet is generated considerably in a space interposed between the ejection opening surface of the liquid ejection head 3 and the printed medium 2. The autogenous airflow is an airflow that flows into a pressure reduced area created by a droplet flying from the ejection opening dragging the surrounding air such that the area between the ejection opening surface provided with the ejection openings and the printed medium tends to become lower than its surroundings. With the above, the droplets ejected from the ejection openings positioned on both end sides of the ejection openings in the arrangement direction are attracted to the center side in the ejection openings array direction; accordingly, the droplet landing positions are affected. The present disclosure can be applied in a manner similar to the above even when the influence of such an autogenous airflow is considered. Description will be given with reference to FIGS. 6A and 6B.

FIGS. 6A and 6B illustrate the components of the autogenous airflow and the inflowing airflow described above in the array direction of the ejection openings with arrows, while in a state in which the ink is ejected from the plurality of ejection openings and recording is performed while the liquid ejection head 3 and the printed medium 2 are moved relative to each other. Specifically, the influence of the autogenous airflow is indicated by arrows 101 to 103, the influence of the inflowing airflow is indicated by the arrows 301 and 302, and the composites of the above components are indicated by arrows 33*a* and 33*b*. FIG. 6A illustrates a case in which the influence of the autogenous airflow on the deviation of the landing positions of the droplets is larger than the influence of the inflowing airflow on the deviation of the landing positions of the droplets. FIG. 6B illustrates a case in which the influence of the inflowing airflow on the deviation of the landing positions is larger than the influence of the autogenous airflow on the deviation of the landing positions.

Since the autogenous airflow attracts the surrounding air towards the center portion area (not shown) of the ejection opening rows, the droplets ejected from the ejection openings positioned on both end sides in the ejection openings array direction are, in particular, attracted to the center side (the right side) in the ejection openings array direction. Furthermore, in a case in which the energy generating elements 15 corresponding to the plurality of ejection opening rows are driven at the same time, since the ease of taking in the airflow from the surroundings is different in each of the arranged ejection opening rows, the amount of attraction in each of the ejection opening rows are different. As illustrated in FIGS. 6A and 6B, the effect 102 exerted on the droplets ejected from the ejection openings positioned at the row end portions of the ejection opening rows 14*b* at the middle is larger than the effects 101 and 103 exerted on the droplets ejected at the row end portions of the ejection opening rows (14*a* and 14*c*) that are not interposed between ejection opening rows.

On the other hand, as described above, the directions in which the inflowing airflows (301 and 302) act on the ejection openings are different in each of the ejection opening rows. Accordingly, the influence exerted on the droplets by the inflowing airflow and the autogenous airflow acts in directions cancelling out each other in the most upstream ejection opening row 14*a* in the relative movement direction, and directions that enhance each other in the most downstream ejection opening row 14*c* in the relative movement direction.

Accordingly, in a case in which both the inflowing airflow and the autogenous airflow are considered, the composite component 33*a* in the most upstream ejecting opening row 14*a* acts towards the center side in the array direction when the influence exerted on the droplets by the autogenous airflow is larger than the influence exerted on the droplets by the inflowing air. The composite component 33*b* in the most downstream ejection opening row 14*c* also acts in a similar manner towards the center side in the array direction; however, since the component 302 of the inflowing airflow and the component 103 of the autogenous airflow act towards the center side in the array direction of the ejection openings, the size of the composite component 33*b* is larger than that of the composite component 33*a*. In other words, the distance at which the droplets ejected from the ejection openings in the end portion area of the ejection opening row 14*a* is dragged towards the center side of the ejection opening row is smaller than the distance at which the droplets ejected from the ejection openings of the ejection opening row 14*c* is dragged towards the center side of the ejection opening row. Accordingly, the present example embodiment can be applied even when the influence of the autogenous airflow is considered. The arrangement intervals of the ejection openings in the end portion areas of the ejection opening row 14*a* positioned on the most upstream side are set smaller than the arrangement intervals of the ejection openings in the end portion areas of the ejection opening row 14*c* positioned on the most downstream side.

As illustrated in FIG. 6B, in a case in which the influence exerted by the inflowing airflow on the deviation of the landing position is larger than the influence exerted by the autogenous airflow, the composite component 33*a* of the ejection opening row 14*a* on the most upstream side acts towards the end portion sides of the ejection opening row. On the other hand, similar to FIG. 6A, the composite component 33*b* of the ejection opening row 14*c* on the most downstream side acts towards the center side in the array direction of the ejection openings. In other words, the droplets ejected from the ejection openings in the end portion area of the ejection opening row 14*a* are dragged towards the end portion side (the left side); however, the droplets of the ejection opening row 14*c* are dragged towards the center side (the right side). Accordingly, the above configuration can be applied even when the influence exerted by the inflowing airflow on the deviation of the landing position is larger than the influence exerted by the autogenous airflow. The arrangement intervals in the end portion areas of the ejection opening row 14*a* positioned on the most upstream side is set smaller than the arrangement intervals of the end portion areas of the ejection opening row 14*c* positioned on the most downstream side.

Note that as illustrated in FIG. 2B, in the liquid ejection head in which the plurality of recording element substrates are arranged in a zigzag manner, the plurality of recording element substrates positioned on the upstream side are affected more by the inflowing airflow than the plurality of recording element substrates positioned on the downstream side. Accordingly, it is only sufficient that, among the plurality of recording elements, the intervals of the ejection openings of at least the recording element substrates positioned on the upstream side in the conveyance direction of the printed medium are determined based on the present example embodiment and, desirably, each of the intervals of the ejection openings of the recording element substrates including the recording element substrates on the downstream side are determined based on the present example embodiment.

Second Example Embodiment (A Case in which there are More than Three Ejection Opening Rows)

In the example embodiment described above, for the purpose of description, the recording element substrates in which three ejection opening rows are arranged are used. However, in order to perform one-pass printing with the page wide type head in a more effective manner, it is desirable that the number of ejection opening rows is larger than three. The present disclosure can be applied in a similar manner even in a recording element substrate in which more than three ejection opening rows are arranged. Description will be given below with reference to FIG. 7.

Figure 7:
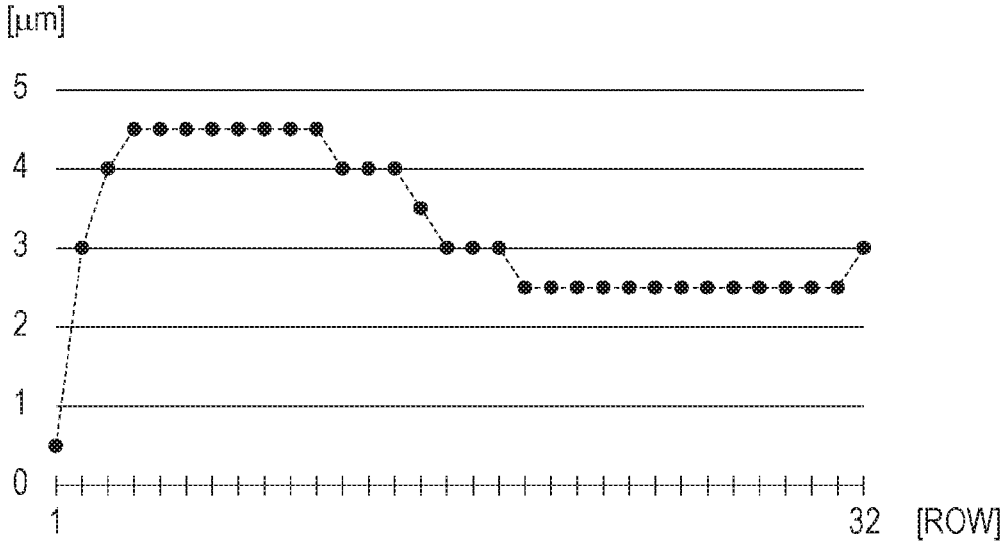
FIG. 7 illustrates a simulation result showing amounts of deviation in landing positions of ejection openings at an end portion of each ejection opening rows in a recording element substrate in which a plurality of ejection opening rows were arranged.

FIG. 7 illustrates a simulation result showing the amounts of deviation in the landing positions of an ejection openings group at the end portion of each ejection opening rows in a recording element substrate in which 32 ejection opening rows were arranged side by side in the relative movement direction. The axis of abscissas indicates the number of each ejection opening row counted from the upstream side in the relative movement direction. The axis of ordinates indicates the amount of deviation in the landing position of the droplet, which had been ejected from the ejection opening in the end portion area of the ejection opening rows, towards the center side in the array direction of the ejection openings. The basic configuration of the liquid ejection head was similar to that of the example embodiment described above. Conditions of the simulation are shown below. The ejection volume of the droplets ejected from the ejection openings was 2.8 pl, the arrangement intervals of the ejection openings were 300 dpi. In a single ejection opening row, 256 ejection openings were arranged, the arrangement intervals of the ejection opening rows were about 340 μm, and 32 rows were arranged at equal intervals. The conveyance speed of the printed medium 2 was about 0.5 m/s. The drive frequency of each ejection opening was 6 kPz.

As illustrated in FIG. 7, even when the number of ejection opening rows was increased, in the ejection opening rows on the most upstream side in the relative movement direction, since the inflowing airflow acts in the direction (towards the end portion side) that cancels the influence of the autogenous airflow, the distance drawn towards the center of the ejection opening row was the smallest. Accordingly, by setting the arrangement intervals of the ejection openings in the end portion area of the ejection opening row positioned on the most upstream side in the relative movement direction smaller than the arrangement intervals of the ejection openings in the end portion area of the ejection opening row adjacent to the ejection opening row positioned on the most upstream side, the deviation in the landing positions of the droplets can be suppressed further.

Furthermore, depending on the size of the inflowing airflow, the arrangement intervals of the ejection openings of the third and fourth rows, counted from the most upstream side or the most downstream side in the relative movement direction towards the center side in the juxtaposition direction of ejection opening rows, are set based on the simulation result illustrated in FIG. 7. With the above, the deviation of the landing position of the droplet can be suppressed further.

Third Example Embodiment (A Case in which there are Ejection Opening Rows that are not Used)

In the recording element substrate 10 in which a plurality of ejection opening rows are arranged, there are cases in which, in consideration of the durability life of the recording element substrate, spare rows that are not used initially in the recording are provided or the rows are used alternately to elongate the product life of the liquid ejection head. The influence of the airflow on the recording can only be exerted between the rows being used (performing ejection and recording). In such a case, the rows that are used may be taken into consideration and the present disclosure can be applied to the rows that are used. Description of the present example embodiment will be given with reference to FIGS. 8A and 8B.

Figure 8A:
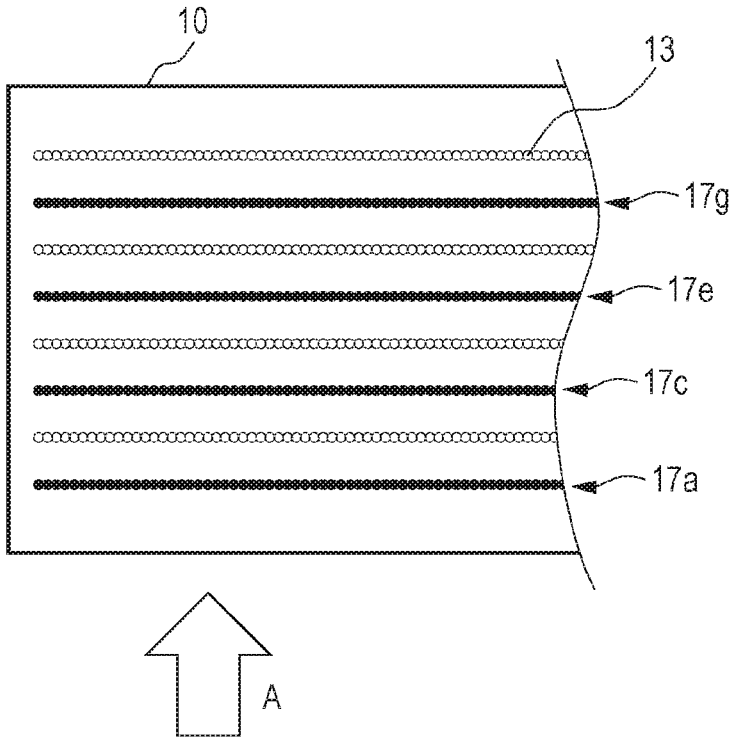
FIG. 8A is a schematic view of a recording element substrate illustrating ejection opening rows used to print a first sheet of printed medium.
Figure 8B:
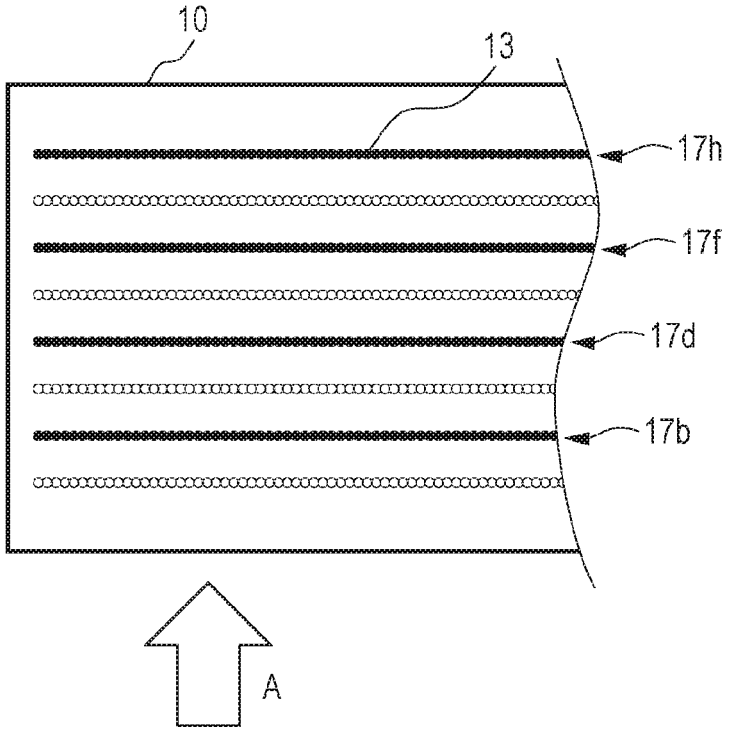
FIG. 8B is a schematic view of a recording element substrate illustrating ejection opening rows used to print a second sheet of printed medium.

In the recording element substrate 10 in FIGS. 8A and 8B, among the entire eight ejection opening rows, for example, four recording ejection opening rows (17*a*, 17*c*, 17*e*, and 17*g*) illustrated in FIG. 8A are used for printing the first printed medium. Four ejection opening rows (17*b*, 17*d*, 17*f*, and 17*h*) in FIG. 8B are used in printing the second sheet. By alternately repeating the above in the subsequent printing, the number of ejections in each row is reduced.

It is the same as the first exemplary embodiment in that, among the ejection opening rows used for recording, in the ejection opening row 17*a* on the most upstream side in the conveyance direction of the printed medium, the inflowing airflow acts in the direction cancelling the influence of the autogenous airflow. Accordingly, the distance in which the droplets are drawn toward the center of the ejection opening row is the smallest in the row on the most upstream side in the conveyance direction of the printed medium among the ejection opening rows that are used, and the amount of deviation of the landing position in the center direction of the ejection opening row is the smallest as well.

Note that the second example embodiment can be applied to the present example embodiment as well. In other words, the arrangement intervals of the ejection openings in the end portion area of the ejection opening row positioned on the most upstream side in the relative movement direction among the ejection opening rows that are used are set smaller than the arrangement intervals of the ejection openings in the end portion area of the ejection opening row adjacent to the ejection opening row on the most upstream side among the ejection opening rows that are used. By so doing, the deviation in the landing position of the droplet can be suppressed further.

Fourth Example Embodiment (A Case in which there are Rows that are not Used Due to Ejection of Inks of a Plurality of Colors)

In the third example embodiment described above, the type of ink has not been stated; however, the present disclosure can be applied to a case in which a plurality of types of ink are supplied to the same single recording element substrate.

Figure 9A:
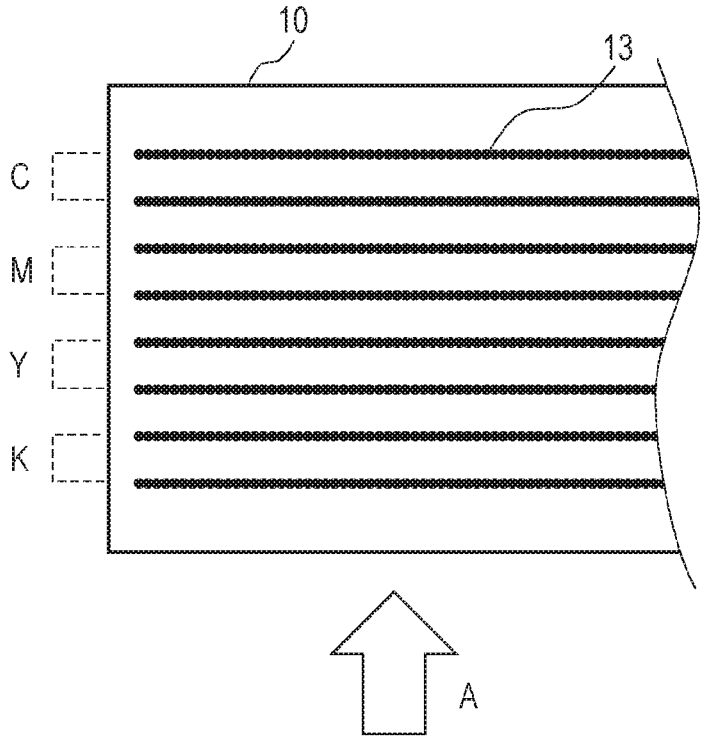
FIG. 9A is a schematic view illustrating a full-color printing mode.
Figure 9B:
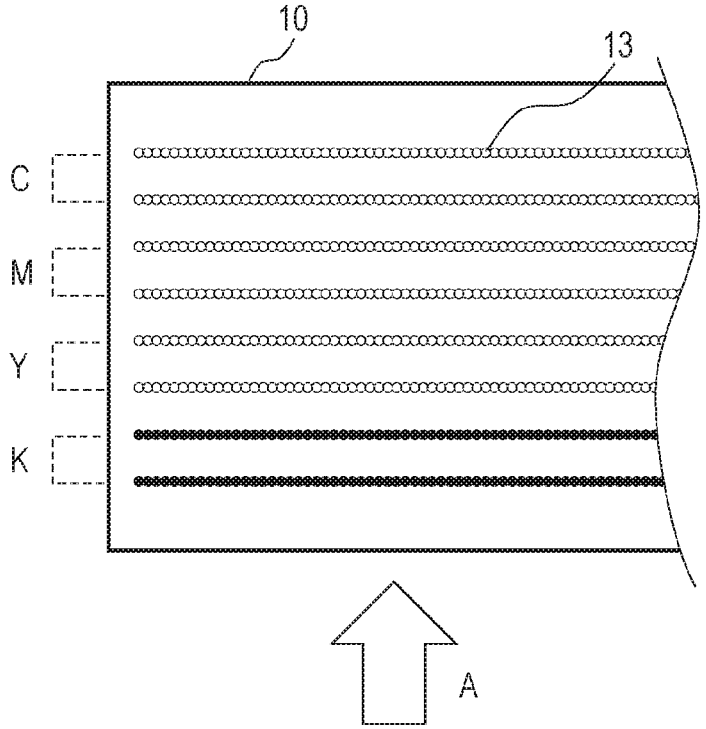
FIG. 9B is a schematic view illustrating a monochrome printing mode that performs printing with only the black ejection opening rows.

FIGS. 9A and 9B each illustrate a recording element substrate in which inks of four colors, namely, C, M, Y, and K (cyan, magenta, yellow, and black) are each supplied to two rows. FIG. 9A illustrates an example of a full-color printing mode in which ink is ejected from each of the above four nozzle rows to perform recording, and FIG. 9B illustrates an example of a monochrome printing mode in which ink is ejected from only the nozzle rows of black (K) to preform recording. In other words, during the full-color printing, eight ejection opening rows of four colors, or CMYK, are used, and during the monochrome printing, two ejection opening rows of one color, or K, are used for the recording.

The present disclosure can be applied to either configurations in FIGS. 9A and 9B. In other words, the present disclosure can be applied to a configuration in which at least two ejection opening rows that eject ink as shown in FIG. 9B are disposed side by side in the movement direction relative to the printed medium. Specifically, the arrangement intervals of the ejection openings of the ejection openings group in the end portion area of the row positioned on the most upstream side is set smaller than the arrangement intervals of the ejection openings in the end portion area of the row positioned on the most downstream side. With the above, the landing position of the droplet reaching the printed medium can be brought close to the desired position.

Fifth Example Embodiment (Arrangement Intervals of Ejection Openings of Adjacent Recording Element Substrates)

In the example embodiment described above, the end portions of a plurality of ejection opening rows provided in a single recording element substrate have been compared with each other; however, the present disclosure can also be applied to the arrangement intervals of ejection openings in end portions of ejection opening rows of recording element substrates that are disposed adjacent to each other and distanced away in the relative movement direction of the recording element substrate and the printed medium.

Figure 10:
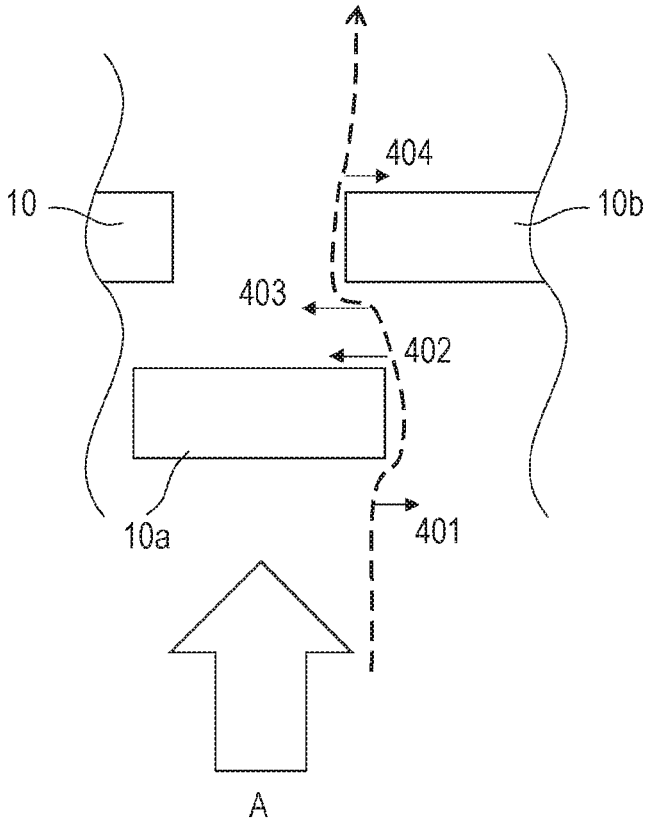
FIG. 10 is a schematic view illustrating a recording element substrate and an inflowing airflow according to a fifth example embodiment.

FIG. 10 is an enlarged view partially illustrating an adjacent portion between the recording element substrates in a page wide type liquid ejection head in which substantially rectangular recording element substrates are arranged in a zigzag manner in the width direction of the printed medium. The array direction components of the inflowing airflow flowing between the recording element substrates 10 at the ejection openings are depicted by arrows 401 to 404.

The component 402 of the inflowing airflow acts towards the center side in the array direction of the ejection openings and the component 403 acts towards the end portion side in the array direction. With the above, by setting the arrangement intervals of the ejection openings in the end portion area of the ejection opening row on the downstream side of the recording element substrates 10*a* that is on the upstream side in the relative movement direction larger than the arrangement intervals of the ejection openings in the end portion area of the ejection opening row on the upstream side of the recording element substrate 10*b* that is on the downstream side in the relative movement direction, the deviation in the landing position of the droplet can be suppressed.

In the above description, description was given using the page wide type liquid ejection head, but the present disclosure is not limited to the page wide type liquid ejection head. In other words, the present disclosure can also be applied to a so-called serial-type liquid ejection head which performs recording while reciprocating in the width direction of printed medium. In the serial type liquid ejection head, in a case in which a plurality of ejection opening rows are provided side by side in the movement direction relative to the printed medium, in other words, in a case in which a plurality of ejection opening rows are disposed side by side in the reciprocating direction, the effect of suppressing the influence of the inflowing airflow on the ejected droplet is large when the configuration of the present disclosure is used.

According to the present disclosure, deviation of the landing position of the droplet caused by the inflowing airflow which is generated when the liquid ejection head is used can be suppressed, and a high quality print image can be obtained at a high speed.

While the disclosure has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-073919, filed Apr. 6, 2018, which is hereby incorporated by reference herein in its entirety.

What is claimed is:

1. A liquid ejection head comprising:

recording element substrates that each include a plurality of ejection opening rows in which ejection openings that eject liquid on a printed medium are arranged, the plurality of ejection opening rows being arranged side by side in a relative movement direction with respect to the printed medium, wherein in the relative movement direction of the printed medium when the printed medium is viewed from the liquid ejection head, and in the plurality of ejection opening rows provided in the recording element substrate, among the plurality of recording element substrates, positioned on an upstream side in the relative movement direction, arrangement intervals of ejection openings in an end portion area of an ejection opening row positioned on a most upstream side in the relative movement direction are smaller than arrangement intervals of ejection openings in an end portion area of an ejection opening row positioned on a most downstream side in the relative movement direction.

2. The liquid ejection head according to claim 1, wherein the liquid ejection head is of a page wide type that includes the plurality of recording element substrates disposed in a zigzag manner.

3. The liquid ejection head according to claim 2, wherein among the plurality of recording element substrates, arrangement intervals of ejection openings in an end portion area of an ejection opening row positioned upstream of a recording element substrate disposed downstream in the relative movement direction are smaller than arrangement intervals of ejection openings in an end portion area of an ejection opening row positioned downstream of a recording element substrate disposed upstream in the relative movement direction.

4. The liquid ejection head according to claim 2, wherein in each of the recording element substrates disposed in the zigzag manner, arrangement intervals of ejection openings in an end portion area of an ejection opening row positioned on the most upstream side in the relative movement direction are smaller than arrangement intervals of ejection openings in an end portion area of an ejection opening row positioned on the most downstream side in the relative movement direction.

5. The liquid ejection head according to claim 1, wherein arrangement intervals of ejection openings in an end portion area of an ejection opening row adjacent to the ejection opening row positioned on the most upstream side in the relative movement direction are smaller than arrangement intervals of ejection openings in an end portion area of an ejection opening row adjacent to the ejection opening row positioned on the most downstream side in the relative movement direction.

6. The liquid ejection head according to claim 1, wherein arrangement intervals of ejection openings in an end portion area of an ejection opening row positioned on the most upstream side in the relative movement direction are smaller than arrangement intervals of ejection openings in an end portion area of an ejection opening row adjacent to the ejection opening row positioned on the most upstream side in the relative movement direction.

7. The liquid ejection head according to claim 1, wherein in ejection opening rows used to perform recording among the plurality of ejection opening rows, arrangement intervals of ejection openings in an end portion area of an ejection opening row positioned on the most upstream side in the relative movement direction are smaller than arrangement intervals of ejection openings in an end portion area of another ejection opening row used to perform recording.

8. The liquid ejection head according to claim 1, wherein in ejection opening rows used to perform recording among the plurality of ejection opening rows, arrangement intervals of ejection openings in an end portion area of an ejection opening row positioned on the most upstream side in the relative movement direction are smaller than arrangement intervals of ejection openings in an end portion area of a second ejection opening row, among other ejection opening rows used to perform recording, when counted downstream from the most upstream side in the relative movement direction.

9. The liquid ejection head according to claim 1, wherein a volume of a single ejection of liquid ejected from the ejection openings is 10 picoliters or less.

10. The liquid ejection head according to claim 1, wherein a speed of a relative movement in the relative movement direction is 0.4 m/s or more.

11. The liquid ejection head according to claim 1, wherein a gap between an ejection opening surface in which the ejection openings are provided and the printed medium is 2 mm or less.

12. The liquid ejection head according to claim 1, the recording element substrates each eject different types of liquid.

13. The liquid ejection head according to claim 1, wherein arrangement intervals of the ejection openings included in the plurality of ejection opening rows are each 600 dpi or more.

14. The liquid ejection head according to claim 1, further comprising:

an energy generating element that generates energy that ejects liquid; and a pressure chamber including the energy generating element, wherein the liquid in the pressure chamber is circulated to a portion external to the pressure chamber.

15. A recording apparatus comprising:

a liquid ejection head that ejects liquid on a printed medium; and a conveying member that conveys the printed medium to the liquid ejection head, wherein the liquid ejection head includes recording element substrates that each include a plurality of ejection opening rows in which ejection openings that eject the liquid on the printed medium are arranged, the plurality of ejection opening rows being arranged side by side in a relative movement direction with respect to the printed medium, and wherein in the relative movement direction of the printed medium when the printed medium is viewed from the liquid ejection head, and in the plurality of ejection opening rows provided in the recording element substrate, among the plurality of recording element substrates, positioned on an upstream side in the relative movement direction, arrangement intervals of ejection openings in an end portion area of an ejection opening row positioned on a most upstream side in the relative movement direction are smaller than arrangement intervals of ejection openings in an end portion area of an ejection opening row positioned on a most downstream side in the relative movement direction.

16. The recording apparatus according to claim 15, wherein the liquid ejection head is of a page wide type that includes the plurality of recording element substrates disposed in a zigzag manner.

* * * * *